United States Patent [19]

McCarthy

[11] 4,350,377

[45] Sep. 21, 1982

[54] LOCK DEVICE AND METHOD FOR SECURING WINDOW SASHES IN A FIXED RELATIVE POSITION

[76] Inventor: Thomas D. McCarthy, 7 Rae La., Norwalk, Conn. 06850

[21] Appl. No.: 130,022

[22] Filed: Mar. 13, 1980

[51] Int. Cl.[3] ..... E05C 17/54

[52] U.S. Cl. ..... 292/288

[58] Field of Search ..... 292/147, 155, 251, 288, 292/144, DIG. 47; 85/56; 411/386, 387

[56] References Cited

U.S. PATENT DOCUMENTS

| | | | |
|---|---|---|---|
| 607,685 | 7/1898 | Feltham | 292/155 |
| 1,632,249 | 6/1927 | Steenrod | 292/147 |
| 3,642,315 | 2/1972 | Alpern | 292/144 |
| 4,138,150 | 2/1979 | Bills | 292/60 |

*Primary Examiner*—Richard E. Moore

*Attorney, Agent, or Firm*—Fitzpatrick, Cella, Harper & Scinto

[57] ABSTRACT

A lock device and method for securing first and second bodies, such as window sashes, which are mounted for relative sliding movement, in a fixed relative position are disclosed. Each of the bodies has a hole extending transversely to the direction of the sliding movement. The holes are arranged to be axially aligned when the bodies are in the fixed relative position. The lock includes an elongate bolt insertable into the holes when they are aligned to prevent relative sliding movement between the bodies. The lock further includes a handle and a device for releasably axially attaching the handle to the bolt so that the bolt may be inserted into and withdrawn from the holes when aligned and so that the handle may be released from the bolt after insertion into the holes.

16 Claims, 4 Drawing Figures

LOCK DEVICE AND METHOD FOR SECURING WINDOW SASHES IN A FIXED RELATIVE POSITION

BACKGROUND OF THE INVENTION

1. Field of the Invention

The present invention relates to securing first and second bodies, which are mounted for relative sliding movement, in fixed relative position, and specifically relates to a lock device for securing one sash of a double-hung window in fixed position relative to the other sash of the window to prevent sliding movement therebetween.

2. Description of Prior Art

Various devices for locking windows of residential, commercial and industrial buildings are known. Objects of all such devices are to allow a person inside the building to render the device inoperative so that the window can be opened and closed to admit varying amounts of fresh air and to render the device operative to lock the window to prevent unauthorized entry from outside the building.

Various devices have also been proposed for locking conventional double-hung windows such as that shown in FIG. 1. As can be seen there, the window, generally indicated at 10, comprises a window frame 11 having vertically extending, parallel slots in which window sashes 12 and 13 are slidably mounted with respect to each other. One typical lock for this form of window includes a hand-operated latch 14 mounted on sash 13 that is rotatable to engage a catch 14*a* mounted on sash 12 to prevent relative slidable movement between sashes 12.

It has been found that this type of lock device does not provide sufficient security since a person seeking unauthorized entrance through the window need only break one of the window panes, turn the rotatable latch 14 to disengage it from the catch 14*a*, and slide one of the sashes 12 or 13 relative to frame 11 to open the window. Furthermore, this security problem associated with lock devices readily visible from outside the window is also encountered with types of windows other than the double-hung type shown in FIG. 1.

Still other lock devices have been proposed. For example, it has been suggested that a hole be drilled in each of the window sashes so that when the sashes are in the closed position, the holes are in axial alignment. A flat-head nail 15 shown in FIG. 1, having a diameter slightly less than the diameter of the aligned holes may be freely inserted into the holes to prevent sliding movement between the sashes of the window. The holes ordinarily are of sufficient depth so that only the head of the nail can be seen in FIG. 1 when inserted therein. While this type of simple lock device is an advantageous precaution and makes unauthorized entry more difficult, a person seeking such entry may still break the window, grasp the nail head and remove the nail from the holes.

SUMMARY OF THE INVENTION

It is an object of the present invention to provide a lock device for preventing relative sliding movement between the sashes of a window.

It is a further object of the present invention to provide a lock device which is difficult for a person seeking unauthorized entry through the window to unlock or render inoperative. It is a more specific object of the invention to provide a lock device that requires the use of a specially designed tool to render the device inoperative to secure the windows together.

In its preferred embodiment, the lock device of the present invention secures first and second bodies such as window sashes, which are mounted for relative sliding movement, in fixed relative position. Each of the bodies has a hole extending transversely to the direction of the sliding movement and the holes are arranged to be in axial alignment when the bodies are in the fixed position. The lock device comprises an elongate bolt fully insertable into both of the holes when they are axially aligned, with no portion thereof exposed on the exterior of either of the bodies, to secure said bodies in the fixed position. The device further includes a graspable handle, and a mechanism for releasably attaching the handle to the bolt for common twisting and axial movement. Accordingly, the bolt may be inserted into and withdrawn from the holes in said bodies by twisting and axial movement of said handle and the handle may be released from the bolt after insertion into the holes.

Other aspects, features and objects of the present invention will be pointed out in or will be understood from the following detailed description of the preferred embodiment provided below in conjunction with the accompanying drawings.

DETAILED DESCRIPTION OF THE PREFERRED EMBODIMENT

Figure 1:
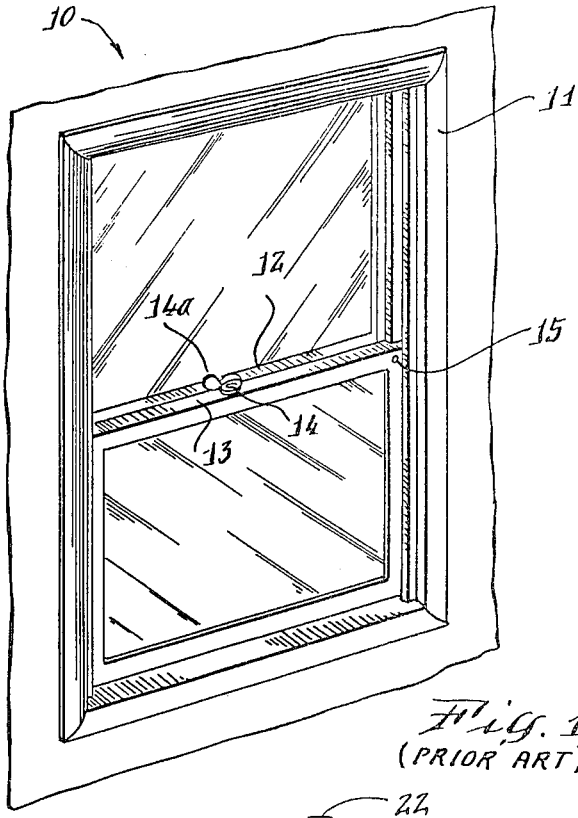
Fig. 1. (PRIOR ART)
FIG. 1 is a perspective view of a conventional double hung window such as is known in the prior art.

Referring again to FIG. 1, the double-hung window, generally shown at 10 includes window frame 11 and sashes 12 and 13 which are mounted in the frame for vertical sliding movement. The construction of the double-hung window 10 is conventional and need not be described further.

Figure 2:
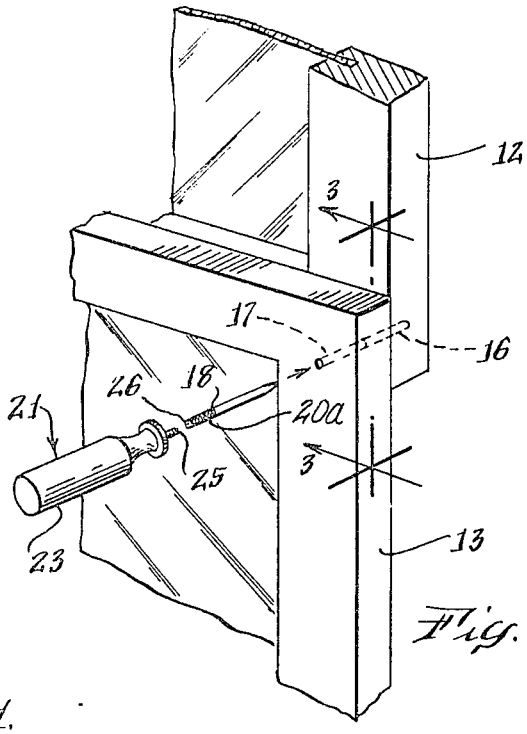
FIG. 2 is an enlarged perspective view of the window sashes of the double-hung window shown in FIG. 1 and of a lock device according to the present invention.
Figure 4:
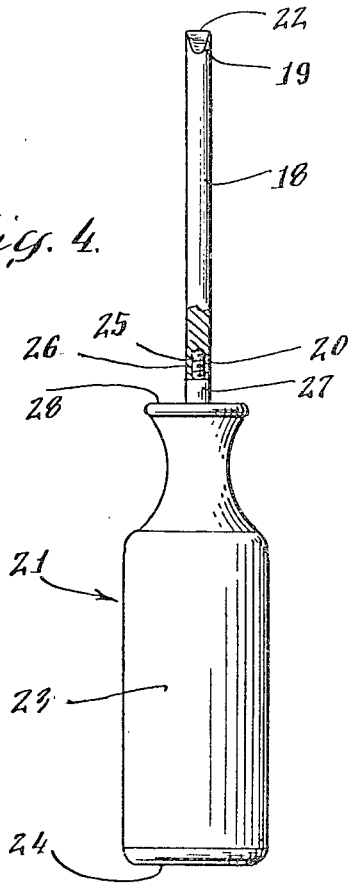
FIG. 4 is an elevational view of the lock device of the present invention with a portion shown in cross-section.
Figure 3:
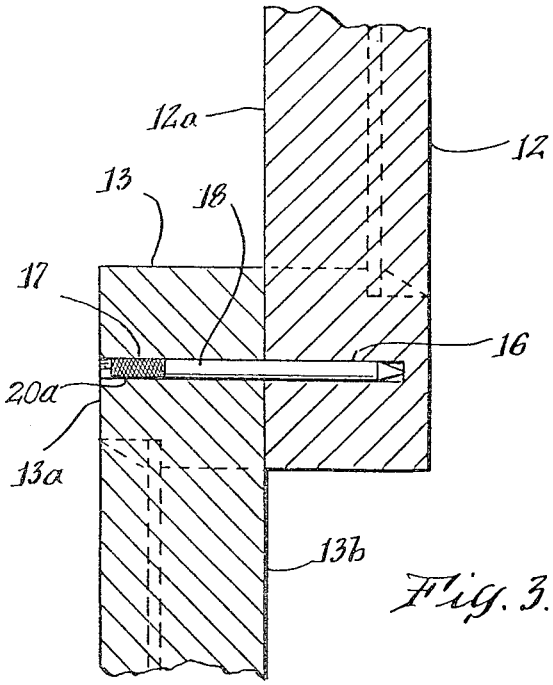
FIG. 3 is an enlarged vertical cross-sectional view taken along plane 3—3 of FIG. 2.

FIGS. 2, 3 and 4 illustrate in detail a lock in accordance with the present invention for securing sash 12 in fixed position relative to sash 13, that is, to prevent relative sliding movement therebetween. More particularly, sash 12 is provided with a hole 16 that extends from the surface 12*a* outwardly a predetermined length. Sash 13 is provided with a hole 17 which extends from the surface 13*a* completely therethrough to surface 13*b*. The holes 16 and 17 are arranged in the respective sashes to be in axial alignment when the sashes 12 and 13 are in the closed position shown in FIGS. 2 and 3. Additionally, the holes 16 and 17 preferably extend generally transversely to the sliding direction of sashes 12 and 13. However, it should be understood that the holes can be at angles other than a precise right angle to the sliding movement of the sashes.

The lock device of the invention includes an elongate bolt 18 comprising a cylindrical pin having a longitudinal axis and having one end portion 19 formed with a pointed blade 22. The cylindrical pin also includes an end portion 20 opposite the one end portion 19 that is releasably, axially attached to a handle 21 which can be easily grasped and manipulated. The means for attaching the handle to the bolt is described in greater detail below.

As shown in FIG. 3, the combined length of holes 16 and 17 should be sufficient to allow for full insertion thereinto of bolt 18 to prevent the end portion 20 from being grasped by pliers or similar tools and removed from the holes 16 and 17 without use of the handle, which is specifically designed for that purpose. Although not essential, it is preferable that lock bolt 18 make a frictional fit with holes 16 and 17 for reasons more fully explained below. That is, holes 16 and 17 should have a diameter that is slightly less than the outer diameter of the cylindrical pin 18 to provide a tight fit between pin 18 and holes 16 and 17. As also noted above, the end portion 19 of the bolt 18 is formed with a blade 22 that, may be engaged with the base 16*a* of hole 16 in sash 12 to provide resistance to rotation of the bolt 18. Further, the end 20 may have a knurled exterior 20*a* also to provide resistance to rotation of the belt.

FIG. 4 illustrates the handle 21 as well as the means for releasably, axially attaching the handle 21 to the bolt 18. Specifically, handle 21 includes a cylindrical grip 23 which can be grasped by a person's hand, and an end 24 through which axial force can be applied to the bolt. Extending from the end of the handle opposite the one end 24 is a threaded screw 25. In the preferred embodiment, handle 21 includes a cylindrical segment 27 which has a diameter substantially equal to the diameter of pin 18. The pin 18 is formed with a threaded bore 26 that extends axially into the end 20 thereof. The thread of the bore 26 matches that of the screw 25.

Referring to FIGS. 3 and 4, the bolt 18 is inserted into holes 16 and 17 by application of axial force and twisting motion to handle 21. The pin 18 may be inserted to a point where the radial shoulder 28 of handle 21 contacts the surface 13*a* of sash 13 and prevents further insertion of locking bolt 18. Alternatively, the blade 22 may engage the base 16*a* prior to engagement of the shoulder with surface 13*a*. However, the bolt should be fully inserted into holes 16 and 17. When either point is reached, the end portion 20 of locking bolt 18 is inserted past the surface 13*a* thereby recessing the bolt into the holes 16 and 17 to prevent grasping of the pin 18 by pliers or other means.

Once the bolt 18 is inserted and tightly fitted into holes 16, handle 21 may be turned to unscrew the screw 25 from the bore 26. As shown in FIG. 3, relative sliding movement of the sashes 12 and 13 is then prevented. Moreover, bolt 18 is tightly engaged within holes 16 and 17 to resist removal therefrom.

To remove the bolt from the holes 16 and 17, the cylindrical segment 27 of handle 21 is simply inserted back into hole 17 and the handle is turned so that the threads on screw 25 engage the threads on bore 26 to once again attach the handle to the bolt 18. The bolt may then be withdrawn by twisting axial movement and relative slidable movement between the sashes is again permitted.

The threaded screw and threaded bore arrangement for releasably axially attaching the handle to the bolt 18 is the preferred mechanism. However, other means for attaching the bolt 18 to handle 21 may be used.

The lock of the present invention is particularly useful to secure one sash of a double-hung window to the other sash of such a window. However, that lock device may be used to secure one body to another body to prevent relative slidable movement transverse to the locking bolt.

It is also to be understood that the location of the holes in sashes 12 and 13 is shown by way of example only, and that the holes could be located at other areas of the sashes. For example, if it were desired to lock the window in a partially opened position, aligned holes could be drilled in the sashes to provide for this. A hole could also extend through one sash and into the window frame 11 to lock the one sash to frame 11. Furthermore, more than one bolt 18 may be used to secure the sashes together.

Although a specific embodiment of the invention has been described herein in detail, such description is for purposes of illustration only and modifications may be made thereto by those skilled in the art in order to adapt this lock device to particular applications.

What is claimed is:

1. Lock means for securing first and second bodies, which are mounted for relative sliding movement, in fixed relative position, each of said bodies having a hole extending transversely to the direction of said sliding movement, said holes being in axial alignment when said bodies are in said fixed position; said lock means comprising:

elongate bolt means insertable into said holes when axially aligned to secure said bodies in said fixed position, said bolt means having a knurled exterior portion for frictionally engaging the interior of at least one of said holes;

handle means; and means for releasably, axially attaching said handle means to said bolt means, said attaching means comprising screw means for releasably securing said handle means to said bolt means, whereby said bolt means may be inserted into and withdrawn from said holes when aligned and whereby said handle means may be released from said bolt means after said bolt means is inserted into said holes.

2. Lock means according to claim 1, wherein said bolt means comprises a cylindrical pin and wherein said attaching means comprises a threaded bore formed in one end of said pin and a threaded screw matable with said bore, secured to and protruding from said handle means.

3. Lock means according to claim 2 wherein said hole in said second body passes only partially thereinto to define a base, wherein said pin is insertable through the hole in said first body into the hole in said second body, and wherein said pin includes one leading end portion configured to nonrotatably engage said base of the hole in said second body.

4. Lock means according to claim 2 or 3, said bolt means being configured to make a friction fit with said holes when inserted therein.

5. Lock means according to claim 1 wherein said first body comprises a first sash or a double-hung window and wherein said second body comprises a second sash of said double-hung window, said bolt means being insertable into said axially aligned holes to prevent relative slidable movement between said first and second sashes.

6. Lock means for securing first and second bodies, which are mounted for relative sliding movement, in fixed relative position, each of said bodies having a hole extending transversely to the direction of said sliding movement, said holes being in axial alignment when said bodies are in said fixed position; said lock means comprising:

elongate bolt means fully insertable into both of said holes when they are axially aligned, with no portion thereof exposed on the exterior of either of said bodies, to secure said bodies in said fixed position, said bolt means having a knurled exterior portion for frictionally engaging the interior of at least one of said holes;

a graspable handle; and means for releasably attaching said handle to said bolt for common twisting and axial movement, whereby said bolt means may be inserted and withdrawn from said holes in said bodies by twisting and axial movement of said handle and whereby said handle may be released from said bolt means after insertion into said holes.

7. Lock means according to claim 6, wherein said attaching means comprises screw means for releasably securing said handle to said bolt means.

8. Lock means according to claim 6, wherein said bolt means comprises a cylindrical pin and wherein said attaching means comprises a threaded bore formed in one end of said pin and a threaded screw matable with said bore secured to and protruding from said handle.

9. Lock means according to claim 8 wherein said hole in said second body passes only partially thereinto to define a base, wherein said pin is insertable through the hole in said first body into the hole in said second body, and wherein said pin includes one leading end portion configured to nonrotatably engage said base of the hole in said second body.

10. Lock means according to claim 6, 7 or 8, said bolt means being configured to make a friction fit with said holes when inserted therein.

11. An elongate locking bolt for securing a first body relative to a second body in fixed relative position, said bodies being mounted for relative sliding movement and each having a hole extending transversely to the direction of said sliding movement, said holes being in axial alignment when said bodies are in said fixed position, said bolt further being adapted to be releasably attached to a handle means having threaded screw means secured to and protruding therefrom; said bolt comprising:

a cylindrical pin having one end portion formed with a threaded bore extending axially inwardly of said cylindrical pin, said screw means being matable with said bore thereby providing for axial attachment and detachment of said handle means to and from said cylindrical pin, said pin further having a knurled exterior portion for frictionally engaging the interior of at least one of said holes.

12. A bolt according to claim 11 wherein said cylindrical pin includes an end portion opposite said one end portion configured to nonrotatably engage at least one of said bodies.

13. Lock means for securing first and second bodies, which are mounted for relative sliding movement, in fixed relative position, each of said bodies having a hole extending transversely to the direction of said sliding movement, said holes being in axial alignment when said bodies are in said fixed position, said hole in said second body passing only partially thereinto to define a base; said lock means comprising:

elongate bolt means fully insertable through the hole in said first body into the hole in said second body when said holes are axially aligned, when no portion thereof exposed on the exterior of either of said bodies, to secure said bodies in said fixed position, said bolt means having a knurled exterior portion for frictionally engaging the interior of at least one of said holes and comprising one leading end configured to nonrotatably engage said base of said hole in said second body;

a graspable handle; and means for releasably attaching said handle to said bolt for both twisting and axial movement, whereby said bolt means may be inserted into said holes in said bodies by twisting and axial movement of said handle until said one leading end of said bolt means engages said base of said second hole; whereby said bolt means may be withdrawn from said holes by similar movement of said handle; and whereby said handle may be released from said bolt means after insertion into said holes.

14. Lock means according to claim 13, wherein said attaching means comprises screw means for releasably securing said handle to said bolt means.

15. Lock means according to claim 13, wherein said bolt means comprises a cylindrical pin and wherein said attaching means comprises a threaded bore formed in one end of said pin and a threaded screw matable with said bore secured to and protruding from said handle.

16. Lock means according to claim 13, 14 or 15, said bolt means being configured to make a friction fit with said holes when inserted therein.

* * * * *

UNITED STATES PATENT AND TRADEMARK OFFICE

CERTIFICATE OF CORRECTION

PATENT NO. : 4,350,377

DATED : September 21, 1982

INVENTOR(S) : THOMAS D. McCARTHY

It is certified that error appears in the above-identified patent and that said Letters Patent is hereby corrected as shown below:

Column 4, line 58, "or" should read -- of --.

Signed and Sealed this

*Eleventh* Day of *January 1983*

[SEAL]

*Attest:*

GERALD J. MOSSINGHOFF

*Attesting Officer*

*Commissioner of Patents and Trademarks*